United States Patent [19]

Snyder et al.

[11] Patent Number: 4,936,058

[45] Date of Patent: Jun. 26, 1990

[54] PRECISION HONE

[76] Inventors: Gary L. Snyder; Joseph P. J. Bryant, both of 4481 Alameda Rd., Placerville, Calif. 95667

[21] Appl. No.: 330,227

[22] Filed: Mar. 29, 1989

[51] Int. Cl.[5] ..... B24B 9/02

[52] U.S. Cl. ..... 51/345; 51/350; 51/330

[58] Field of Search ..... 51/345, 339, 340, 338, 51/331, 330, 350, 352, 165.93, 34 H, 349

[56] References Cited

U.S. PATENT DOCUMENTS 2,991,597 7/1961 Calvert ..... 51/349

FOREIGN PATENT DOCUMENTS 106549 2/1939 Australia ..... 51/345

*Primary Examiner*—Frederick R. Schmidt
*Assistant Examiner*—M. Rachuba
*Attorney, Agent, or Firm*—Leon Gilden

[57] ABSTRACT

A precision hone is set forth particularly for use in the honing of relatively small diameter bores, wherein a main body telescopingly receives therein a sleeve insert secured at its upper end to a tension release spring. A plurality of diametrically opposed and aligned tension pins are directed through the sleeve insert and imposed upon an upper surface of a wedge holder that rotatably receives within a securement boss a bifurcated latch plate integrally secured to a depth wedge that is reciprocatably mounted by means of rotation of a micrometer thimble rotatably secured to the wedge holder and the micrometer sleeve to reciprocate the depth wedge and radially adjust a honing stone relative to an associated mandrel. Application of force to a forward surface of the tension release spring biases the depth wedge rearwardly by its securement to the depth wedge holder to thereby release radial force upon the honing stone and enable quick removal of a workpiece receiving the honing stone when the hone assembly is rotatably mounted to a rotating mandrel.

10 Claims, 5 Drawing Sheets

FIG 6
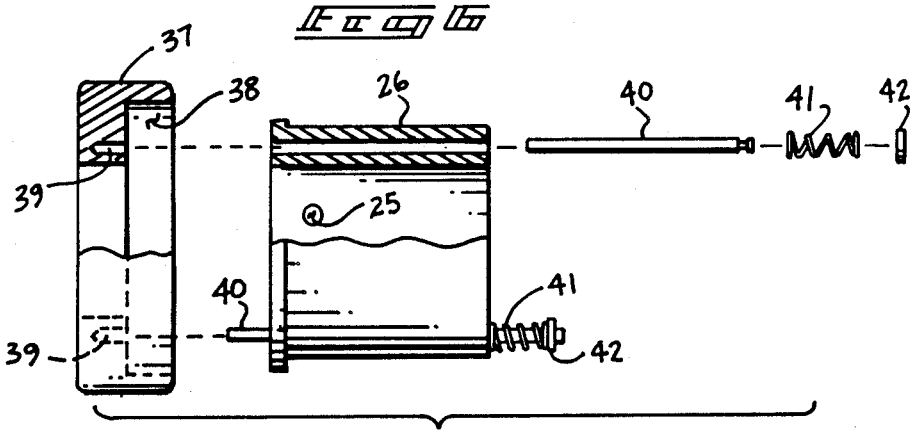
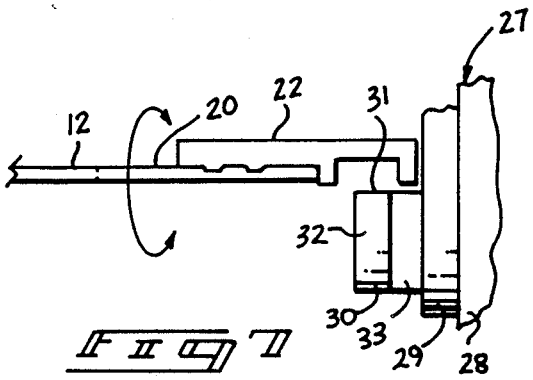
FIG 7
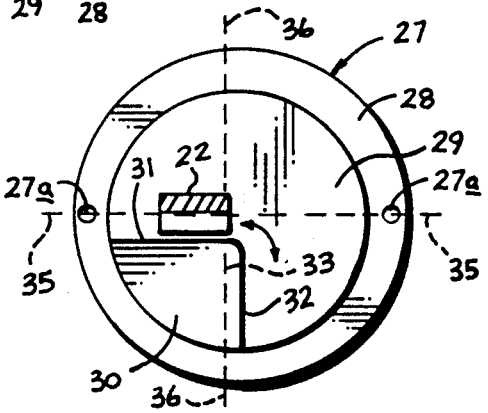
FIG 8

PRECISION HONE

BACKGROUND OF THE INVENTION

1. Field of the Invention

The field of invention relates to honing apparatus, and more particularly pertains to a new and improved precision hone utilizing a novel interlatching relationship between a honing stone wedge to selectively release tension to a associated honing stone, as desired, to enable tension release relative to an associated workpiece.

2. Description of the Prior Art

The use of honing apparatus is well known in the prior art. The prior art has heretofore been of relatively complex and elaborate organization to require laborious attention to the engagement and disengagement of a honing stone relative to a workpiece or utilizing complex inter-relationship of structure to effect such release.

U.S. Pat. No. 3,619,956 to Gehring utilizes a pneumatically operative piston to effect tension release and application relative to a honing stone to be positioned within an annular workpiece. The Gehring patent does not lend itself to the mechanically streamlined and effective release of the honing stone relative to a workpiece, as set forth by the instant invention.

U.S. Pat. No. 3,380,197 to Fitzpatrick sets forth a complex pneumatically operative honing apparatus wherein an arbor is adapted to lock onto or hold a workpiece in a stationary position as the abrasive members of the honing tool reciprocate and rotate regardless of eccentricity or misalignment of the tool relative to the workpiece and while an effective and operative device the device fails to provide for a quick manual release of the honing stones relative to the workpiece, as set forth by the instant invention.

U.S. Pat. No. 3,094,820 to Hannon sets forth a honing stone retainer utilizing fluid pressure remotely controlled relative to the device to radially direct a honing stone relative to a arbor within the device wherein the patent is again of a relatively complex organization relative to the scope of deployment of such devices, as contemplated by the instant invention.

U.S. Pat. No. 2,991,597 to Calvert sets forth a guide and abrading device for a honing tool wherein the honing stone is radially directed relative to a workpiece by means of an internal wedge that is reciprocatably mounted by means of an axially oriented shaft for securement to a hydraulically actuated mechanism, wherein the instant invention attempts to overcome the complexities of such prior art devices by utilizing a micrometer wedge thimble to reciprocate rotatably joined wedge to effect tensioning of an associated honing stone relative to the interior of a workpiece.

U S. Pat. No. 2,988,859 to Chaffey sets forth an additional honing tool head that is typical of the prior art utilizing fluid pressure for adjustment of the associated honing stones relative to a workpiece.

As such, it may be appreciated that there is a continuing need for a new and improved precision hone as set forth by the instant invention that addresses both the problems of ease of use and simplicity of construction, and in this respect, the present invention substantially fulfills this need.

SUMMARY OF THE INVENTION

In view of the foregoing disadvantages inherent in the known types of honing devices now present in the prior art, the present invention provides a precision hone wherein the same may be readily mounted within a rotating mandrel and adjusted by means of a circumferentially micrometer ring to adjust honing stone tension and may further be manually actuated to release tension on the honing stone for disengagement of the honing stone relative to a workpiece. As such, the general purpose of the present invention, which will be described subsequently in greater detail, is to provide a new and improved precision hone which has all the advantages of the prior art honing devices and none of the disadvantages.

To attain this, the present invention comprises a main cylindrical body including a sleeve insert positioned within the body at a forward end thereof with an included tension release collar secured to the sleeve slidingly overlying the body. A mandrel adapter receives a mandrel coaxially with the body, sleeve, and tension release collar. The mandrel is provided with a sliding wedge therethrough to radially extend a honing stone relative to the mandrel with a rearward end of the wedge provided with a bifurcated latch plate rotatably securable to a cylindrical wedge holder. The wedge holder is received within a groove of an associated micrometer thimble rotatably mounted on the cylindrical body to adjust and reciprocate the wedge of the mandrel with an underlying tension spring positioned and disposed against an underlying surface of the depth wedge holder with a spring tensioning thimble threadedly mounted to a rearwardmost end of a rearwardly directed skirt of the micrometer thimble coaxially surrounding the main body to adjust pressure of a honing stone against an interior of a workpiece. The tension spring is maintained within the spring tensioning thimble by a spring plate provided with downwardly extending legs disposed against an annular floor of the thimble. Spaced below the spring plate is a web positioned rearwardly of the main body with a rearwardly extending shank to be received within a rotatably mounted mandrel to rotate the hone organization relative to a workpiece.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved precision hone device which has all the advantages of the prior art honing devices and none of the disadvantages.

It is another object of the present invention to provide a new and improved precision hone device which may be easily and efficiently manufactured and marketed.

It is a further object of the present invention to provide a new and improved precision hone device which is of a durable and reliable construction.

An even further object of the present invention is to provide a new and improved precision hone device which is susceptible of a low cost of manufacture with regard to both materials and labor, and which accordingly is then susceptible of low prices of sale to the consuming public, thereby making such precision hone devices economically available to the buying public.

Still yet another object of the present invention is to provide a new and improved precision hone device which provides in the apparatuses and methods of the prior art some of the advantages thereof, while simultaneously overcoming some of the disadvantages normally associated therewith.

Still another object of the present invention is to provide a new and improved precision hone device wherein the same provides for manual release of pressure of the associated honing stone relative to an interior wall of a workpiece to be honed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is an orthographic view, partially in section, of the tension release spring, the sleeve insert, their geometrical association and relationship.

FIG. 7 is an orthographic view, taken in elevation, of the rearwardmost end of the depth wedge and its association with the depth wedge holder.

FIG. 8 is a top orthographic view of the depth wedge holder of the instant invention.

DESCRIPTION OF THE PREFERRED EMBODIMENT

Figure 1:
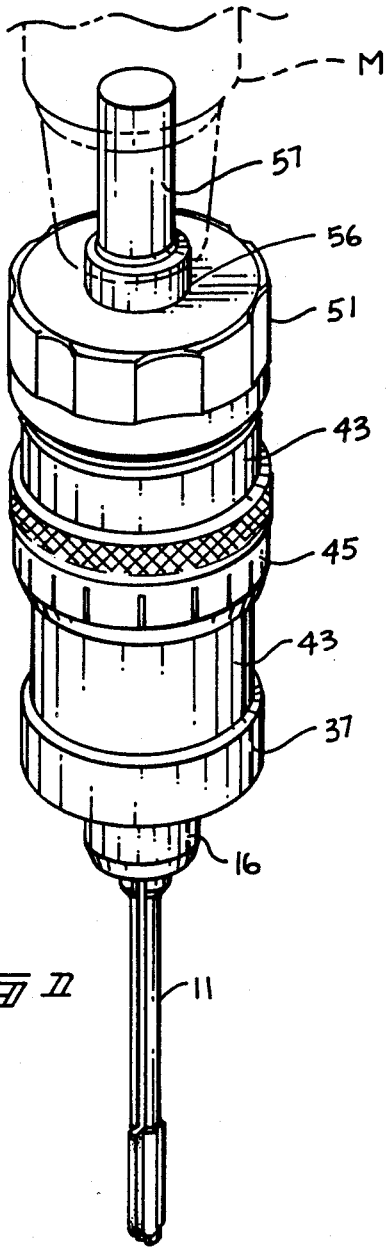
FIG. 1 is an isometric illustration of the instant invention.

With reference now to the drawings, and in particular to FIGS. 1 to 8 thereof, a new and improved precision hone embodying the principles and concepts of the present invention and generally designated by the reference numeral 10 will be described.

More specifically, it will be noted that the precision hone 10 of the instant invention essentially comprises (with reference to FIG. 2) the honing stone mandrel 11 provided with a coextensive slot therewithin for slidingly receiving the depth wedge 12 axially therealong within the slot The depth wedge 12 is provided with a wedge nose 12*a* cooperating with an undercut wedge 13 formed within the honing stone 14 to reciprocate the honing stone 14 relative to the mandrel 11 in the direction indicated by the arrow. The honing stone mandrel and the depth wedge 12 are received within a central axial bore of a mandrel adapter 16 with a retaining spring 15 formed with a forward end to overlie the honing stone 14 and a rearward end, of generally "V" shaped configuration, to be received within the bore of the mandrel adapter 16 and overlie the depth wedge 12 to maintain a depth wedge 12 and a honing stone 14 in nested orientation relative to the mandrel 11 as the retaining spring 15 is positioned adjacent the depth wedge 12 and received within the elongate slot of the mandrel 11. A lock screw 17 is threadedly received within a threaded through-extending bore of the mandrel adapter 16 to impose upon the mandrel 11 and maintain the mandrel 11 in secured relationship relative to the mandrel adapter 16.

An abutment pin 18 is orthogonally directed through an exterior wall of the mandrel adapter 16 and is diametrically offset relative to the mandrel adapter 16 to be received within the bifurcated slot 19 formed within the rear end of the honing stone mandrel 11 to limit rearward positioning of the mandrel 11 within the mandrel adapter 16 and properly orient the mandrel 11 thereto. The rear face of the mandrel adapter 16 is provided with a mandrel adapter slot formed diametrically along the rear face of the mandrel adapter 16 to receive a wedge flange 20 therewithin. The wedge flange 20 is formed downwardly depending and aligned with the elongate depth wedge 12 and wherein a bifurcated latch plate 22 formed with fingers orthogonally oriented relative to the length of the wedge 12 is integrally secured to a rearwardmost end of the depth wedge 12. As the wedge abutment flange 20 limits forward reciprocation of the depth wedge 12 relative to the honing stone mandrel 11, the bifurcated latch plate 22 is received within a groove 33 formed within a securement boss 30 of the depth wedge holder 27, to be discussed in more detail below. A lock screw 24 (see FIG. 3) is directed through a bore formed orthogonally through a wall of the main body 43 of the hone 20 and received within a threaded bore 25 formed within the sleeve insert 26 (see FIGS. 3 and 6) to abut the mandrel adapter and be received within an annular recess 23 to fixedly join the sleeve insert 26 and the mandrel adapter 16 relative to the main body 43.

Figure 2:
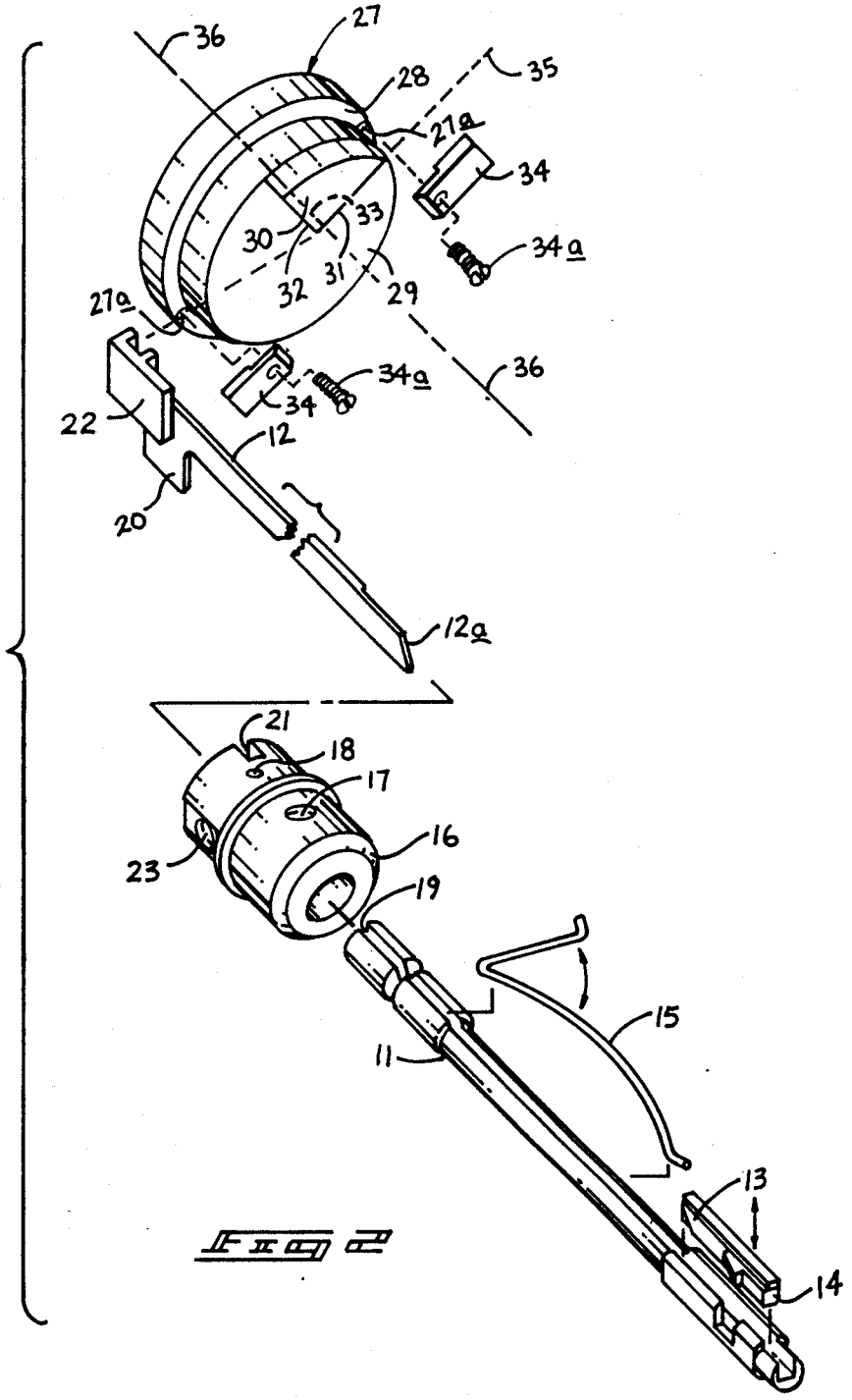
FIG. 2 is an isometric exploded illustration of the mandrel, wedge, mandrel adapter, and its association to the annular depth wedge holder of the instant invention coaxially aligned and mounted within the main body of the device.
Figure 3:
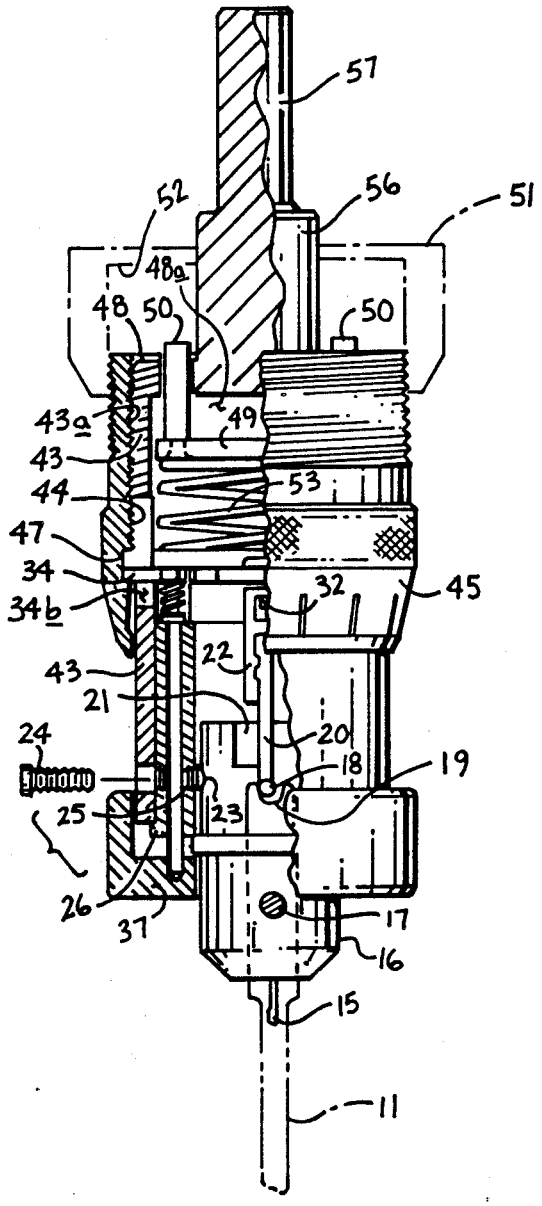
FIG. 3 is an orthographic view, partially in section, of the instant invention illustrating the various components, their configuration and their relationship.

With reference to FIGS. 2, 3, 7, and 8, the depth wedge holder 27 is formed with cylindrical boss plate 28 including a coaxially aligned overlying cylindrical boss 29 integrally formed to an upper surface of the cylindrical boss plate 28. Formed to an upper surface of the cylindrical boss 29 is a securement boss 30, wherein the securement boss 30 is oriented within a quadrant defined by two orthogonally oriented diameters of the axially aligned cylindrical boss plate 28 and the cylindrical boss 29 defined as a first diameter 35 and a second diameter 36. The securement boss 30 includes a solid face 31 spaced from the first diameter 35 with an undercut face 32 aligned with the second diameter 36. The undercut face 32 includes an underlying groove 33 defined by the undercut face 32 and the upper surface of the cylindrical boss 29, as best illustrated in FIGS. 2, 7, and 8. Reference to FIGS. 3, 7, and 8 illustrate that the bifurcate latch plate 22 is directed axially of the sleeve insert 26 prior to securement of the mandrel adapter 16 relative to the sleeve insert 26 and will be in a first position, as illustrate in FIG. 8, wherein the orthogonally oriented fingers of the latch plate 22 are positioned adjacent the solid face 31 of the securement boss 30. A ninety degree rotation of the bifurcated latch plate 22 relative to the securement boss 30 positions the fingers of the bifurcated latch plate 22 to encompass the undercut face 32 by the lowermost finger of the bifurcated latch plate 22 received within the groove 33 with the upper finger overlying the groove 33, as illustrated in FIG. 3 for example. In this manner, the bifurcated latch plate 22 and associated depth wedge 12 are secured to the depth wedge holder 27. The depth wedge holder 27 is itself secured to the micrometer thimble 47 by diametrically opposed securement wings 34 secured to diametrically opposed ends of the cylindrical boss plate by threaded fasteners **34*a*. The securement wings 34 are directed through diametrically opposed slots 34*b* formed within the main body 43** in an organization to be discussed in more detail below.

Reference to FIGS. 3 and 6 illustrates the annular tension release ring 37 formed with an annular recess 38 to receive the sleeve insert 26 therewithin. The tension release spring is provided with tension pin bores 39 diametrically aligned and formed on opposite sides of the axis of the tension release spring 37 to fixedly receive upper ends of tension pins 40 therewithin, as illustrated in FIG 3. The tension pins 40 are directed through axially offset and parallel bores formed within the sleeve insert 26 and capture the sleeve insert 26 by pin springs 41 between a bottom surface of the sleeve insert 26 and a pin spring keeper 42 to secure in a biased manner the sleeve insert 26 within the annular recess 38 of the tension release spring 37. As noted, the sleeve insert 26 and the assemblage with the tension release spring 37 as illustrated in FIG. 6, is secured relative to the main body 43 by the lock screw 24 threadedly received within the threaded bore 25 that also secures the mandrel adapter 16 relative to the sleeve insert 26. It is understood that the rearwardmost ends of the diametrically opposed tension pins 40 contact the upper surface diametrically of the cylindrical base plate 28 whereupon rearward retraction of the tension release spring 37 directs the tension pins 40 rearwardly and also accordingly, the depth wedge holder 17 within the annular groove 47 of the micrometer thimble 45.

Figure 4:
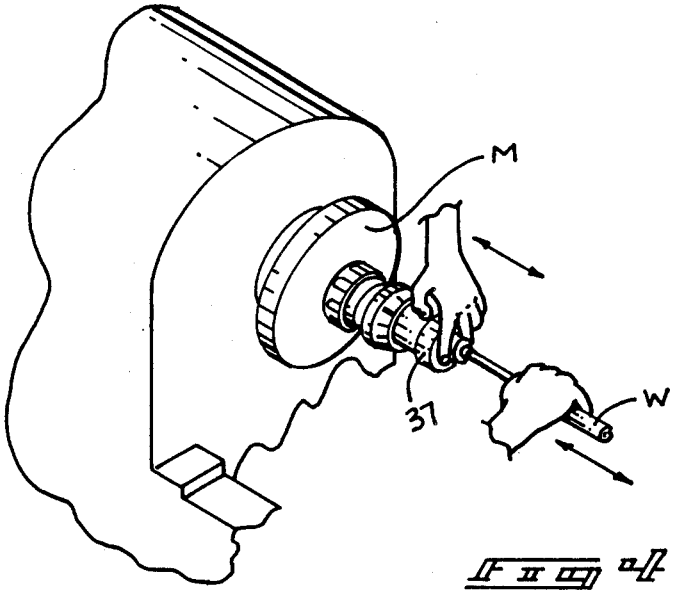
FIG. 4 is an isometric illustration of the instant invention and manual application of force to the tension release spring to release tension on the associated honing stone mounted interiorly of the workpiece.
Figure 5:
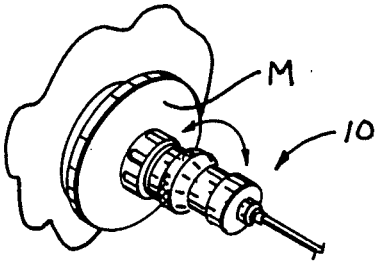
FIG. 5 is an isometric illustration of the instant invention mounted for operative rotation within an association rotating mandrel.

Reference to FIG. 3 illustrates the micrometer thimble 45 formed with an internal coaxial bore with micrometer threads 44 formed within the interior surface of the micrometer thimble 35 to threadedly cooperate with main body micrometer thread **43*a* to enable rotative reciprocation of the micrometer thimble 45 along the main body 43 spaced from and underlying the tension release spring 37. Positioned above the micrometer threads 44 is an annular groove 47 to receive the securement wings 34 of the depth wedge holder 27 therewithin. The annular groove 47 is of a length greater than that of the thickness of the securement wings 34 to enable the depth wedge holder 27 to be directed rearwardly within the annular groove 47 upon application of force, as illustrated in FIG. 4, to the tension release spring 37. As the depth wedge holder 27 secures the bifurcated latch plate 22 and associated depth wedge 12 to the depth wedge holder 27, rearward retraction of the depth wedge holder 27 will release tension upon the honing stone mandrel 11 and thereby enable a workpiece "W" to be withdrawn from about the honing stone mandrel 11, as illustrated in FIG. 4** for example.

To provide adjustment of operating pressure against the underlying surface of the depth wedge holder 27 and thereby to the honing stone 14, a main spring 53 is positioned in abutment with a rear surface of the depth wedge holder 27 at one end and with a spring plate 49 at its other end. The spring plate 49 is maintained within the main body 43 by an inwardly directed annular flange 48 formed at a rear terminal end of the main body 43. The spring plate 49 is formed with spring plate legs 50 directed rearwardly of the spring plate 49 and extends outwardly to an associated spring tensioning thimble 51 that is threadedly received about a threaded lowermost rearwardly extending skirt of the micrometer thimble 45 that extends coaxially about a rearward portion of the main body 43. The positioning of the spring tension thimble 51 relative to the lowermost end of the main body 43 determines the amount of pressure directed to the depth wedge holder 27 and associated honing stone 14 by way of the depth wedge 12. The spring plate legs 50 are imposed upon an annular floor 52 of the annular spring tension thimble 51 to determine the amount of pressure directed to the associated main spring 53. The annular flange 48 is integrally formed to an annular web **48*a* wherein the annular web 48*a* has orthogonally formed and coaxially of the annular web 48*a* and the associated main body 43 a rearwardly extending first annular shank 56 with a reduced diameter second annular shank 57 directed rearwardly of the first annular shank 56. The second annular shank 57 is receivable within a rotating mandrel "M" for rotation of the precision hone 10 relative to a workpiece "W", as illustrated in FIG. 4**.

The manner of usage and operation of the instant invention therefore should be apparent from the above disclosure and accordingly, no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A precision hone device comprising, in combination, an elongate cylindrical housing, and a cylindrical sleeve insert telescopingly mounted within a forward end of said housing and including an annular tension ring resiliently securing said sleeve insert thereto wherein said cylindrical housing is formed of an external diameter greater than that of said tension ring and said housing and formed with a cylindrical recess to receive said sleeve insert and said cylindrical housing therein, and a mandrel adapter fixedly secured relative to and interiorly positioned of said sleeve insert, and an elongate mandrel including a honing member radially and adjustably mounted relative to a forward end of said elongate mandrel with a wedge member reciprocatably mounted within said elongate member with a forward end of said wedge member radially adjusting said honing member, and a rear end of said wedge member selectively securable to a depth wedge holder mounted interiorly of said cylindrical housing rearwardly of said sleeve insert, and at least one force transmitting pin fixedly secured to said tension ring at one end and abutting an upper surface of said depth wedge holder at its other end whereupon rearward reciprocation of said tension ring directs said depth wedge holder rearwardly and simultaneously withdraws the forward end of said wedge member from said honing member to enable radial retraction of said honing member within said elongate mandrel.

2. A precision hone device as set forth in claim 1 wherein said depth wedge holder includes a cylindrical boss plate of a diameter substantially equal to that of a diameter defined within said cylindrical housing and further including a cylindrical boss coaxially and integrally secured to an upper surface of said cylindrical boss plate, and including a securement boss integrally secured to an upper surface of said cylindrical boss to selectively secure a rear end of said wedge member.

3. A precision hone device as set forth in claim 2 wherein said securement boss is positioned within a quadrant defined by orthogonally bisecting diameters of said cylindrical boss with a first solid face formed on said securement boss positioned rearwardly of one of said diameters with a second undercut face orthogonally oriented relative to said solid face defining a groove thereunder wherein said groove is aligned with the other of said diameters.

4. A precision hone device as set forth in claim 3 wherein the rear end of said wedge member includes a bifurcated latch plate including spaced fingers orthogonally oriented relative to the wedge member, wherein the fingers encompass the undercut face of the securement boss when the rear end of said wedge member is interengaged with said securement boss.

5. A precision hone device as set forth in claim 4 wherein the wedge member includes a wedge flange receivable within a mandrel slot formed diametrically across a rear face of said mandrel adapter to limit forward reciprocation of said wedge member relative to said elongate mandrel.

6. A precision hone device as set forth in claim 5 further including a micrometer thimble threadedly securable to a rearwardmost portion of said cylindrical housing and provided with an internal annular groove to receive securement wings integrally secured to said depth wedge holder wherein said securement wings are directed through diametrically opposed slots formed in said cylindrical housing, and said micrometer thimble is reciprocatably positionable relative to said housing to reciprocate said depth wedge holder within said housing and adjust pressure on said honing member.

7. A precision hone device as set forth in claim 6 wherein said micrometer thimble includes a rearwardly directed annular skirt including external threads thereon to receive a spring tension thimble thereon to contact force transmitting members wherein said force transmitting members are integrally secured to an annular flange to adjust tension upon a main spring captured between said annular flange and an underlying surface of depth wedge holder.

8. A precision hone device as set forth in claim 7 wherein a rearwardly extending annular shank is integrally secured to a connecting web formed at a rearwardmost end of said main housing.

9. A precision hone device as set forth in claim 8 wherein a locking member is threadedly directed through an aperture in said main housing and received within a threaded bore within said sleeve insert, and wherein said mandrel adapter is provided with an annular recess wherein said locking member locks said cylindrical housing, said sleeve insert, and said mandrel adapter together.

10. A precision hone device as set forth in claim 9 wherein at least one force transmitting pin includes a second pin diametrically opposed and spaced from a first pin, and the pins include pin springs captured between said sleeve insert and said other end to resiliently bias the tension ring forwardly of the sleeve insert.

* * * * *